US010147370B2

(12) United States Patent
Verbeure et al.

(10) Patent No.: US 10,147,370 B2
(45) Date of Patent: Dec. 4, 2018

(54) VARIABLE REFRESH RATE GAMMA CORRECTION

(71) Applicant: NVIDIA Corporation, Santa Clara, CA (US)

(72) Inventors: Tom Verbeure, Sunnyvale, CA (US); Robert Jan Schutten, San Jose, CA (US); Gerrit A. Slavenburg, Fremont, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 29 days.

(21) Appl. No.: 15/338,253

(22) Filed: Oct. 28, 2016

(65) Prior Publication Data

US 2017/0124934 A1 May 4, 2017

Related U.S. Application Data

(60) Provisional application No. 62/248,234, filed on Oct. 29, 2015.

(51) Int. Cl.
*G09G 3/36* (2006.01)

(52) U.S. Cl.
CPC ... *G09G 3/3611* (2013.01); *G09G 2320/0247* (2013.01); *G09G 2320/0252* (2013.01); *G09G 2320/0276* (2013.01); *G09G 2320/0673* (2013.01); *G09G 2340/0435* (2013.01)

(58) Field of Classification Search
CPC ..... G09G 3/3611; G09G 2320/0247
See application file for complete search history.

(56) References Cited

U.S. PATENT DOCUMENTS

2002/0004413 A1* 1/2002 Inoue ..... G09G 5/006 455/566
2002/0071493 A1* 6/2002 Shirahama ..... H04N 5/4401 375/240.26
2002/0075250 A1* 6/2002 Shigeta ..... H04L 29/06 345/204
2002/0175907 A1* 11/2002 Sekiya ..... G09G 3/3611 345/211
2003/0001810 A1* 1/2003 Yamaguchi ..... G09G 3/3648 345/87
2003/0206242 A1* 11/2003 Choi ..... G09G 5/006 348/441
2004/0218094 A1* 11/2004 Choi ..... H04N 5/46 348/441
2005/0052553 A1* 3/2005 Kido ..... H04N 5/232 348/296
2005/0213843 A1* 9/2005 Nojima ..... G06T 5/009 382/274
2006/0198009 A1* 9/2006 Morita ..... G09G 3/3648 359/245
2006/0208960 A1* 9/2006 Glen ..... G09G 5/395 345/3.1

(Continued)

*Primary Examiner* — Sejoon Ahn
(74) *Attorney, Agent, or Firm* — Zilka-Kotab, P.C.

(57) ABSTRACT

A method, computer program product, and system perform gamma correction for a variable refresh rate display panel. An image is received for display on a screen of a display device. The image is adjusted based on gamma correction factors that are dependent on a variable refresh rate of the display device and the adjusted image is output for display on the screen of the display device.

20 Claims, 15 Drawing Sheets

(56) References Cited

U.S. PATENT DOCUMENTS

| | | | | |
|---|---|---|---|---|
| 2007/0229423 | A1* | 10/2007 | Tyrrell | G09G 3/3622 345/89 |
| 2008/0055318 | A1* | 3/2008 | Glen | G09G 3/20 345/501 |
| 2008/0100553 | A1* | 5/2008 | Shen | G09G 3/2092 345/89 |
| 2008/0100598 | A1* | 5/2008 | Juenger | G09G 5/36 345/204 |
| 2008/0114942 | A1* | 5/2008 | Brown | G06F 12/0808 711/144 |
| 2009/0046990 | A1* | 2/2009 | Takemura | B60R 1/00 386/222 |
| 2009/0237423 | A1* | 9/2009 | Shih | G09G 3/3406 345/690 |
| 2015/0029167 | A1* | 1/2015 | Tanaka | H04N 5/66 345/204 |
| 2016/0196802 | A1* | 7/2016 | Nho | G09G 3/20 345/212 |

* cited by examiner

Current Component Value

Desired Component Value

| | 0 | 16 | 32 | 48 | 64 | 80 | 96 | 112 | 128 | 144 | 160 | 176 | 192 | 208 | 224 | 240 | 256 |
|---|---|---|---|---|---|---|---|---|---|---|---|---|---|---|---|---|---|
| 0 | **0** | 28 | 47 | 63 | 79 | 94 | 111 | 129 | 148 | 166 | 183 | 199 | 215 | 232 | 251 | 256 | 256 |
| 16 | 0 | **16** | 42 | 61 | 80 | 98 | 117 | 136 | 156 | 174 | 192 | 208 | 224 | 241 | 254 | 256 | 256 |
| 32 | 0 | 8 | **32** | 56 | 76 | 96 | 115 | 136 | 155 | 174 | 192 | 209 | 225 | 242 | 254 | 256 | 256 |
| 48 | 0 | 6 | 22 | **48** | 72 | 92 | 112 | 133 | 154 | 173 | 192 | 209 | 225 | 242 | 256 | 256 | 256 |
| 64 | 0 | 4 | 17 | 38 | **64** | 89 | 109 | 130 | 151 | 171 | 190 | 208 | 225 | 242 | 256 | 256 | 256 |
| 80 | 0 | 3 | 13 | 32 | 54 | **80** | 105 | 127 | 148 | 169 | 189 | 207 | 224 | 241 | 254 | 256 | 256 |
| 96 | 0 | 2 | 9 | 27 | 48 | 69 | **96** | 122 | 144 | 165 | 186 | 205 | 222 | 240 | 254 | 256 | 256 |
| 112 | 0 | 2 | 8 | 23 | 43 | 65 | 85 | **112** | 140 | 161 | 182 | 201 | 219 | 237 | 253 | 256 | 256 |
| 128 | 0 | 2 | 7 | 20 | 40 | 61 | 81 | 100 | **128** | 156 | 177 | 198 | 216 | 235 | 252 | 256 | 256 |
| 144 | 0 | 1 | 6 | 18 | 37 | 58 | 78 | 96 | 115 | **144** | 173 | 194 | 213 | 232 | 250 | 256 | 256 |
| 160 | 0 | 1 | 6 | 16 | 34 | 54 | 75 | 93 | 111 | 130 | **160** | 190 | 210 | 229 | 248 | 256 | 256 |
| 176 | 0 | 1 | 5 | 15 | 32 | 52 | 72 | 90 | 108 | 126 | 145 | **176** | 206 | 226 | 246 | 256 | 256 |
| 192 | 0 | 1 | 5 | 14 | 30 | 49 | 69 | 87 | 104 | 122 | 141 | 160 | **192** | 223 | 244 | 256 | 256 |
| 208 | 0 | 1 | 6 | 13 | 29 | 47 | 67 | 85 | 101 | 119 | 136 | 155 | 175 | **208** | 242 | 256 | 256 |
| 224 | 0 | 2 | 6 | 14 | 28 | 47 | 66 | 83 | 99 | 115 | 132 | 151 | 170 | 190 | **224** | 256 | 256 |
| 240 | 0 | 1 | 5 | 12 | 26 | 44 | 63 | 80 | 97 | 113 | 130 | 147 | 166 | 185 | 205 | **240** | 256 |
| 256 | 0 | 1 | 5 | 10 | 23 | 39 | 58 | 76 | 92 | 108 | 124 | 142 | 161 | 180 | 200 | 217 | **256** |

*Fig. 4A*

Current Component Value

Desired Component Value

| | 0 | 16 | 32 | 48 | 64 | 80 | 96 | 112 | 128 | 144 | 160 | 176 | 192 | 208 | 224 | 240 | 256 |
|---|---|---|---|---|---|---|---|---|---|---|---|---|---|---|---|---|---|
| 0 | **0** | 61 | 86 | 101 | 115 | 131 | 148 | 168 | 191 | 210 | 224 | 238 | 253 | 256 | 256 | 256 | 256 |
| 16 | 0 | **18** | 58 | 83 | 103 | 123 | 145 | 170 | 196 | 216 | 230 | 243 | 254 | 256 | 256 | 256 | 256 |
| 32 | 0 | 3 | **35** | 70 | 92 | 114 | 139 | 165 | 193 | 215 | 229 | 242 | 253 | 256 | 256 | 256 | 256 |
| 48 | 0 | 1 | 14 | **51** | 83 | 106 | 131 | 158 | 188 | 212 | 227 | 241 | 252 | 256 | 256 | 256 | 256 |
| 64 | 0 | 0 | 6 | 31 | **67** | 98 | 123 | 152 | 183 | 208 | 224 | 238 | 250 | 256 | 256 | 256 | 256 |
| 80 | 0 | 0 | 3 | 19 | 49 | **83** | 115 | 144 | 175 | 201 | 219 | 234 | 247 | 256 | 256 | 256 | 256 |
| 96 | 0 | 0 | 1 | 11 | 37 | 65 | **99** | 134 | 163 | 190 | 211 | 227 | 242 | 255 | 256 | 256 | 256 |
| 112 | 0 | 0 | 1 | 6 | 26 | 56 | 81 | **115** | 151 | 178 | 201 | 219 | 236 | 251 | 256 | 256 | 256 |
| 128 | 0 | 0 | 0 | 4 | 18 | 46 | 72 | 96 | **132** | 167 | 192 | 213 | 229 | 247 | 256 | 256 | 256 |
| 144 | 0 | 0 | 0 | 2 | 11 | 37 | 65 | 89 | 111 | **147** | 183 | 205 | 224 | 242 | 256 | 256 | 256 |
| 160 | 0 | 0 | 0 | 1 | 8 | 27 | 56 | 82 | 104 | 126 | **163** | 198 | 219 | 238 | 256 | 256 | 256 |
| 176 | 0 | 0 | 0 | 1 | 5 | 20 | 49 | 74 | 97 | 119 | 141 | **179** | 214 | 234 | 253 | 256 | 256 |
| 192 | 0 | 0 | 0 | 0 | 3 | 14 | 39 | 67 | 90 | 112 | 134 | 156 | **195** | 229 | 250 | 256 | 256 |
| 208 | 0 | 0 | 0 | 0 | 2 | 9 | 29 | 58 | 83 | 105 | 127 | 150 | 172 | **211** | 247 | 256 | 256 |
| 224 | 0 | 0 | 0 | 0 | 1 | 5 | 20 | 47 | 74 | 98 | 119 | 142 | 165 | 188 | **226** | 256 | 256 |
| 240 | 0 | 0 | 0 | 0 | 0 | 3 | 12 | 37 | 66 | 90 | 111 | 133 | 157 | 181 | 204 | **242** | 256 |
| 256 | 0 | 0 | 0 | 0 | 0 | 1 | 6 | 21 | 51 | 77 | 100 | 122 | 146 | 170 | 193 | 214 | **256** |

*Fig. 4B*

VARIABLE REFRESH RATE GAMMA CORRECTION

CLAIM OF PRIORITY

This application claims the benefit of U.S. Provisional Application No. 62/248,234, titled "Variable Refresh Rate Gamma Correction," and filed Oct. 29, 2015, the entire contents of which is incorporated herein by reference.

FIELD OF THE INVENTION

The present invention relates to display systems, and more particularly to gamma correction for a variable refresh rate display panel.

BACKGROUND

Conventional display devices (e.g., Cathode Ray Tube (CRT), Liquid Crystal Displays (LCD), Light Emitting Diode (LED), Organic LED (OLED), Active-Matrix OLED (AMOLED), etc.) operate at fixed refresh rates such as 60 Hz, 85 Hz, or 120 Hz. However, a graphics processing unit (GPU) may generate frames of pixel data at a variable rendering rate that is asynchronous with the fixed refresh rate of the display device.

Newer display devices may be configured to operate synchronously with the GPU utilizing a dynamic refresh frequency. For example, some monitors may be compatible with NVIDIA's G-SYNC™ technology that enables the display device to synchronize the refresh of pixel elements for displaying a frame with the variable rendering rate of the GPU. The GPU is configured to transmit frames of pixel data to the display device via the video interface as the frames are rendered, and the display device is configured to refresh the pixels of the display device in response to receiving the frames of pixel data rather than at a fixed frequency refresh rate. In other words, the refresh rate of the display device is not fixed at a particular frequency, but instead adjusts dynamically to the rate image data is received from the GPU.

As long as the GPU renders frames of image data at a reasonably fast rendering rate, the types of image artifacts associated with conventional systems may be reduced. However, in some cases, the GPU may have trouble rendering particular frames in a reasonable amount of time due to the complexity of a scene. For example, a particular frame of pixel data may take, e.g., 100 ms to be rendered, which corresponds to a dynamic refresh frequency of 10 Hz for that particular frame. The effective refresh rate of the monitor when there are large delays between successive frames may cause issues.

For example, most image display technologies (e.g., LCD panels) have a lower and upper bound refresh frequency at which the display can reproduce an image with maximum quality. When the displays were driven at a fixed frequency refresh rate, this operational restriction was easy to meet because the fixed refresh frequency could be selected within the lower and upper bounds of the display. However, when using a variable refresh rate technology, such as NVIDIA's G-SYNC™ technology, the GPU may require a variable and unpredictable amount of time to generate the next image data for display. The amount of time required to generate the next frame of image data for display can be larger than the amount of time available while staying above the minimum refresh frequency requirements of the display.

When the refresh rate of the video signal that is arriving at the display driving hardware is lower than this minimum refresh rate, the display driving hardware needs to refresh the panel by repainting the previous image to stay above the minimum refresh frequency. FIG. 1A illustrates an example of image repetition on a variable refresh display device to avoid flicker, in accordance with the prior art. A set of timing diagrams 100 in FIG. 1A includes an input signal that includes encoded data for five images (e.g., Image 1, Image 2, Image 3, Image 4, and Image 5) received by a variable refresh display device. An output signal includes data sent to an LCD panel of the variable refresh display device. Images 1, 2, and 3 are received at a frequency that is above the minimum refresh frequency of the variable refresh display device. Therefore, Images 1, 2, and 3 are output to the LCD panel when those images are received. However, Image 4 is not received soon enough to satisfy the minimum refresh frequency of the variable refresh display device. Therefore, Image 3 is redisplayed. Then, Images 4 and 5 are output to the LCD panel when those images are received by the variable refresh display device.

If the new image (e.g., Image 4) arrives while the previous image (e.g., Image 3) is being redisplayed, a temporal collision occurs: the incoming image needs to be displayed as soon as possible for the best possible visual representation and to avoid stutter, but the previous image is in the process of being displayed. For a traditional LCD panel, display of the previous image needs to be completed before the new image can be displayed.

FIG. 1B illustrates an example of image repetition on a variable refresh display device with a temporal collision between two images, in accordance with the prior art. An output signal includes data sent to an LCD panel of the variable refresh display device. Images 1, 2, and 3 are received at a frequency that is above the minimum refresh frequency of the variable refresh display device. Therefore, Images 1, 2, and 3 are output to the LCD panel when those images are received. However, Image 4 is not received soon enough to satisfy the minimum refresh frequency of the variable refresh display device. Therefore, Image 3 is redisplayed. Image 4 is received while Image 3 is being redisplayed—causing a temporal collision between the repeated Image 3 and new Image 4. Display of Image 4 is delayed until the display of repeated Image 3 is completed. Then, Image 5 is output to the LCD panel when it is received by the variable refresh display device.

When a fixed frame rate is used to refresh a display device, to achieve a desired gamma curve, a constant gamma correction function is used. However, for a variable refresh rate display, using a constant gamma correction is often not sufficient to obtain this desired gamma curve for all refresh rates. As a result, this may result in visual flickering of the display device. Thus, there is a need for addressing these issues and/or other issues associated with the prior art.

SUMMARY

A method, computer program product, and system are disclosed for performing gamma correction for a variable refresh rate display. An image is received for display on a screen of a display device. The image is adjusted based on gamma correction factors that are dependent on a variable refresh rate of the display device and the adjusted image is output for display on the screen of the display device.

BRIEF DESCRIPTION OF THE DRAWINGS

FIG. 4A illustrates overdrive coefficients, configured to perform only overdrive operations, in accordance with one embodiment;

FIG. 4B illustrates overdrive coefficients, configured to perform overdrive operations and gamma correction based on the refresh rate, in accordance with one embodiment;

DETAILED DESCRIPTION

A refresh timeout corresponding to the minimum refresh frequency associated with the variable refresh rate display device may be specified based on one or more of an image rendering rate at which images are rendered by the GPU (i.e., the inverse of the image duration), a target frame rate specified by a user or environmental conditions (e.g., power consumption, temperature, etc.). It will be appreciated that, a specified lower bound for the refresh frequency of a display device corresponds to a maximum allowed frame duration. An upper bound for the refresh frequency may also be specified for the display device, where the upper bound corresponds to a minimum allowed frame duration. The refresh timeout ensures that the minimum refresh frequency is met and is less than or equal to the inverse of the minimum allowed frame duration. The frame duration is associated with the display device whereas an image duration is associated with the GPU. The frame duration is the amount of time that an image is displayed before the display device is refreshed. The image duration is the amount of time during which an image is rendered by the GPU. The image duration may also include the amount of time needed to store the image into a frame buffer. The image duration may vary for one or more images in a sequence of images.

Refresh Rate Dependent Gamma Correction Parameters

Each component (e.g., red, green, blue) of the pixels of an LCD panel emits light that is dependent on a numerical value that is provided through the digital interface of the panel. For example, when the interface can transfer a range of 0 to 255 for each component, then a value of 0 results in the darkest value, and a value of 255 results in the brightest value. A value of 128 will result in a value that is somewhere in between. In a typical LCD panel, the relationship between the input value and the output value is not linear but follows a curve that is, to a certain extent, exponential. This curve is called the gamma curve.

Figure 1A:
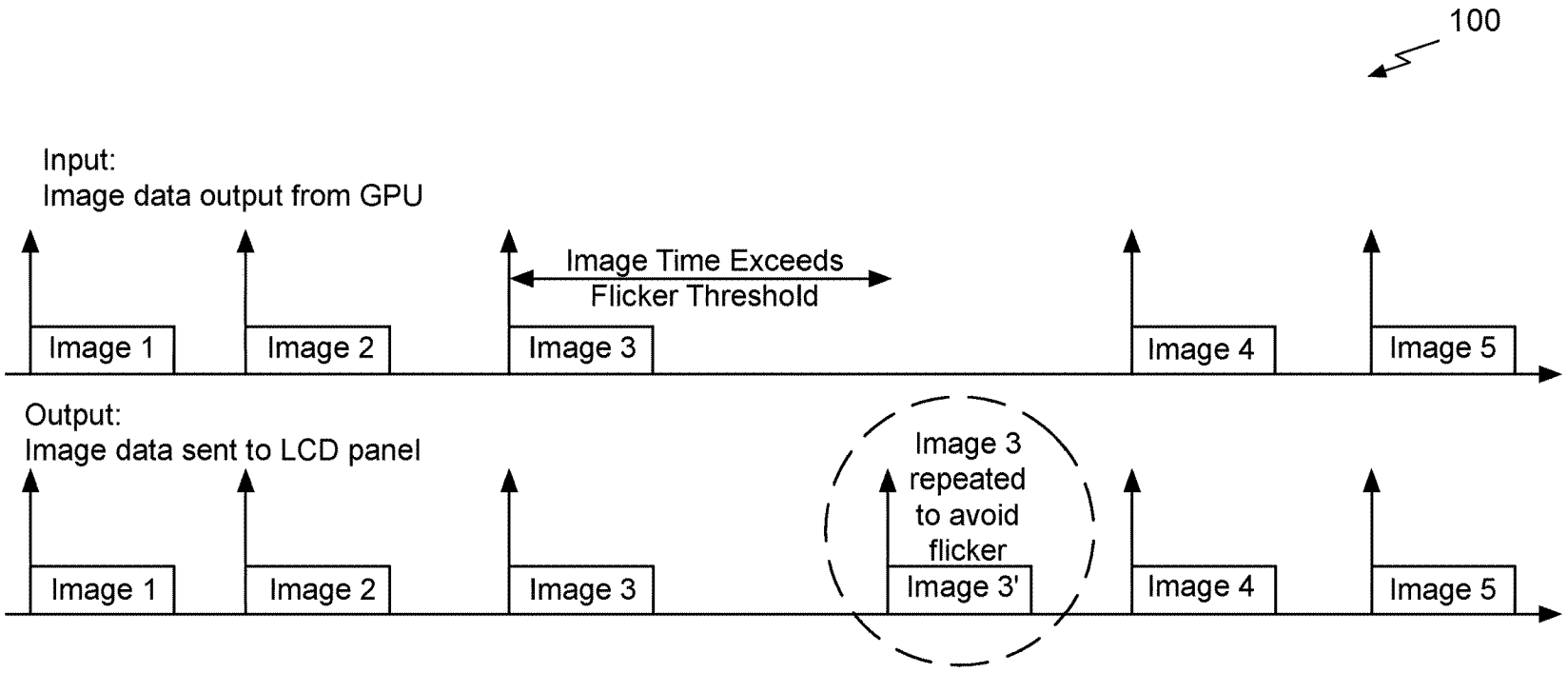
(PRIOR ART) Fig. 1A
FIGS. 1A and 1B illustrate an example of image repetition on a variable refresh display device to avoid flicker, in accordance with the prior art.
Figure 1B:
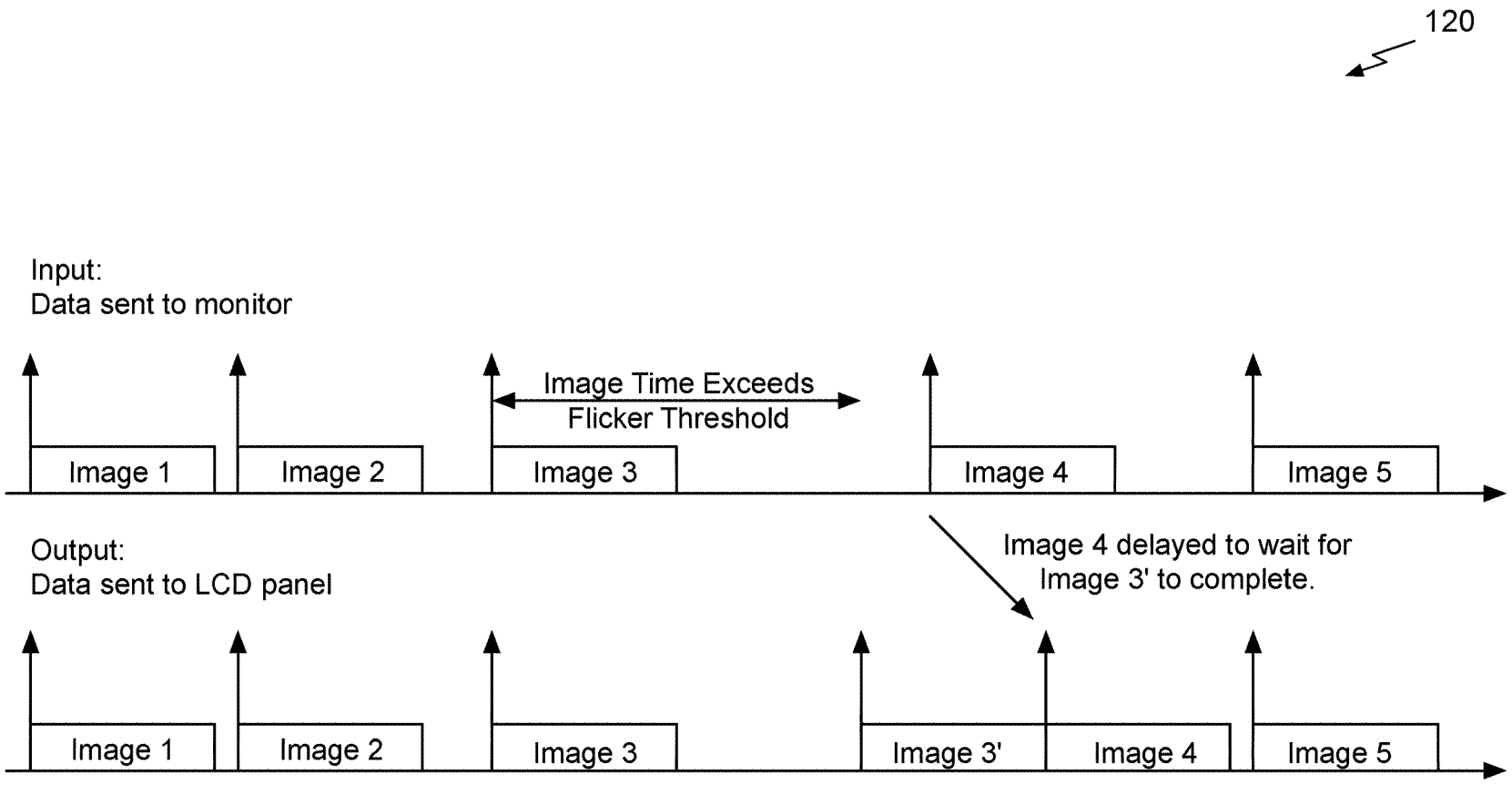
(PRIOR ART) Fig. 1B
Figure 2A:
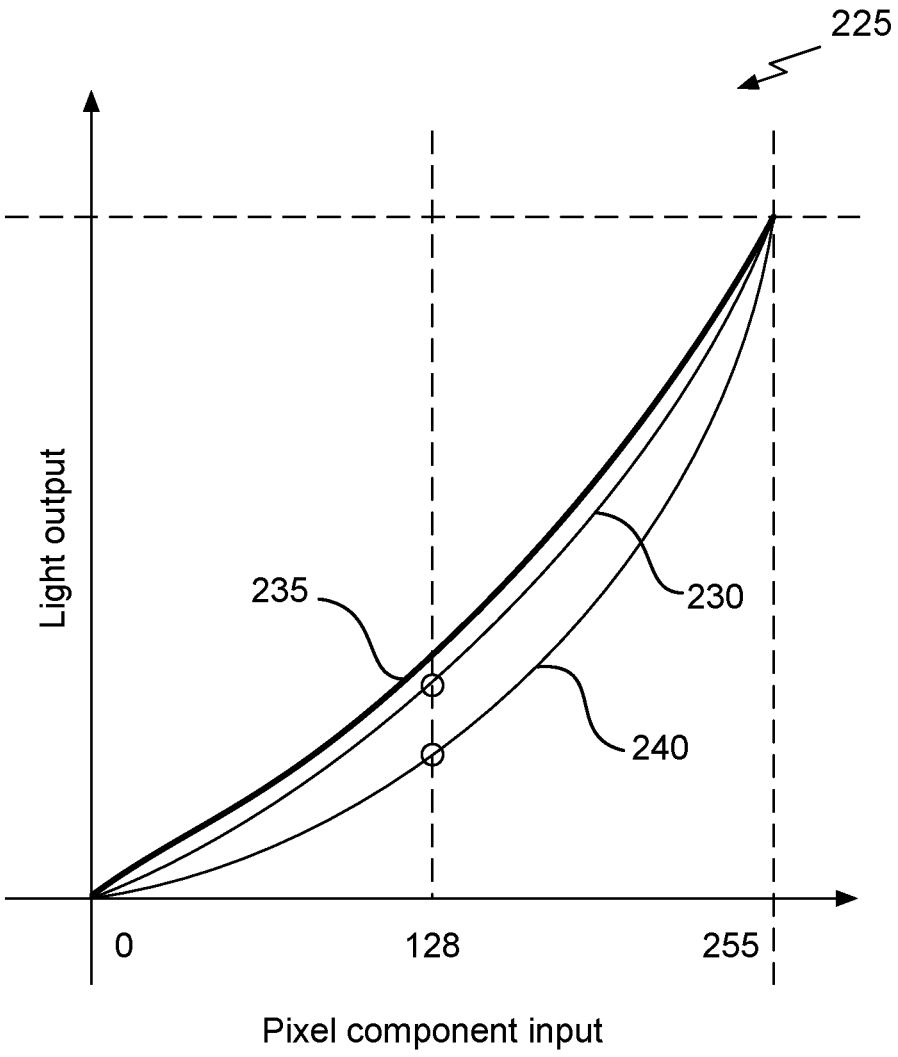
FIG. 2A illustrates gamma curves associated with different refresh rates, in accordance with one embodiment.

FIG. 2A illustrates gamma curves associated with different refresh rates, in accordance with one embodiment. For a given LCD panel, the exact curvature is not constant for different conditions; for most LCD panels, the curvature changes for varying horizontal line scan rates. For example, on the same LCD panel, a higher horizontal line scan rate often results in a gamma curve with a lower exponential factor than for a lower horizontal line scan rate. As shown in FIG. 2A, a curve 230 is associated with a higher horizontal line scan rate and a curve 240 is associated with a lower horizontal line scan rate. In practice, a value of 128 at the input for a high horizontal line scan rate may result in a light output that is greater than for a low horizontal line scan rate. It is also possible that a value of 128 at the input for a high horizontal line scan rate may result in a light output that is a less than for a low horizontal line scan rate. The line 235 is the ideal gamma curve and when gamma correction is applied, the pixel component values that are displayed by the LCD panel have been corrected to lie on the line 235.

Variations in light output for different horizontal line scan rates are normally not a problem for a variable refresh rate monitor because the horizontal line scan rate is usually always kept constant and is linked to the maximum refresh rate, while the vertical blanking interval changes continuously to lower the refresh rate below the maximum refresh rate. However, there are LCD panels for which the gamma curve changes when the vertical blanking interval changes even if the horizontal line scan rate stays constant. This is a serious problem: when the GPU generates an image of a constant gray color at varying refresh rates, the varying gamma curves 230 and 240 produce varying levels of light output of the panel when gamma correction is performed. The end result is perceived as flicker, which can be very disturbing for a viewer.

In one embodiment, the driving electronics of the LCD panel or the GPU itself (in case of a so-called direct drive setup) adjust the component value sent to the LCD panel to compensate for variations in the gamma curve due to varying refresh rates in such a way that, for a given original value to be displayed, the light output stays constant irrespective of the refresh rate. Refresh rate dependent gamma correction factors may be used to adjust component values, as described further herein. The refresh rate dependent gamma correction factors need only be determined once for an LCD panel, for example, during panel qualification. The actual gamma curve for a particular LCD panel may be measured for different refresh rates across a useful refresh rate range of the LCD panel. Gamma correction factors may then be computed for each of the refresh rates, where the gamma correction factors transform the behavior of the system such that the desired gamma curve is achieved. For example, for the gamma curves 230 or 240, refresh rate dependent gamma correction factors may adjust pixel component input values to lie on the desired gamma curve 235.

Figure 2B:
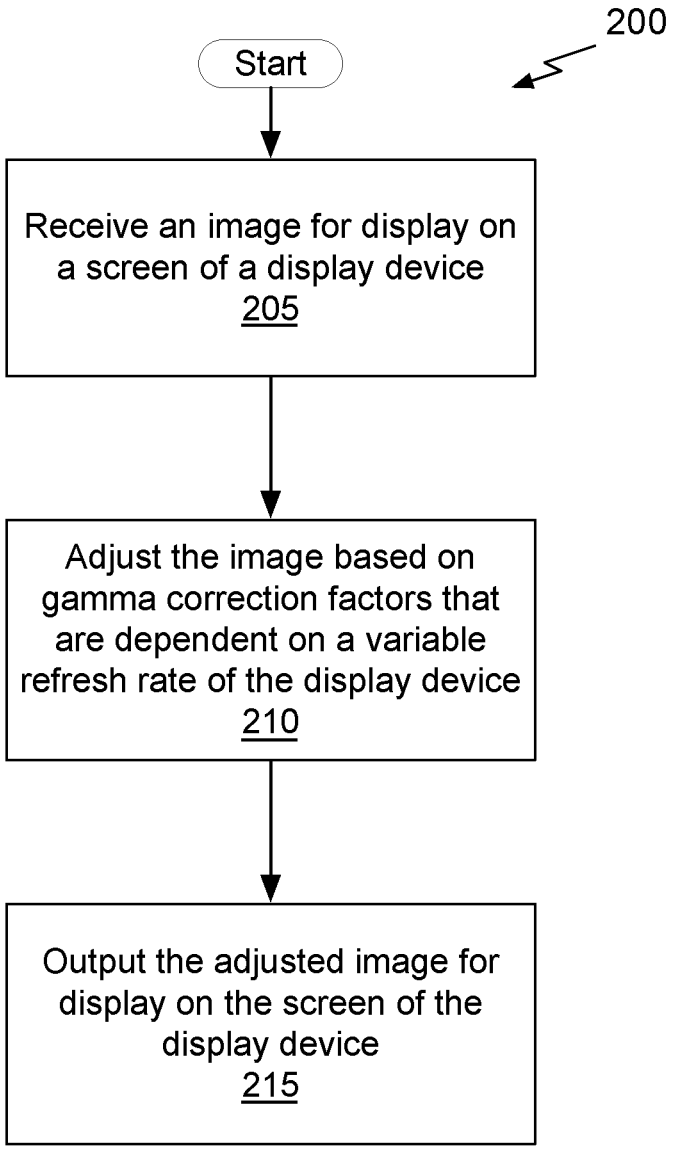
FIG. 2B illustrates a flowchart of a method for adjusting an image based on refresh rate dependent gamma correction factors for a dynamic refresh rate capable display device, in accordance with one embodiment.

FIG. 2B illustrates a flowchart of a method 200 for adjusting an image based on refresh rate dependent gamma correction factors for a dynamic refresh rate capable display device, in accordance with one embodiment. Although method 200 is described in the context of a refresh rate dependent gamma correction unit, the method 200 may also be performed by a program, custom circuitry, or by a combination of custom circuitry and a program. Furthermore, persons of ordinary skill in the art will understand that any system that performs method 200 is within the scope and spirit of embodiments of the present invention.

At step 205, an image is received for display on a screen of a display device. In the context of the following description, the first image, and subsequent images, may be generated by a GPU that is configured to render a two or three-dimensional scene to produce an image for display. The first image is a complete image intended to fill the display screen of a display device and the first image may be read from a frame buffer. In most variable refresh rate display devices, the arrival time of each new image will be unknown as the rendering rate of the images will vary based on the complexity of the scene being rendered.

At step 210, the image is adjusted based on refresh rate dependent gamma correction factors. In one embodiment, the value one or more components of at least one pixel may be adjusted by a refresh rate dependent gamma correction unit. In the context of the following description, the refresh rate dependent gamma correction factors are values used to adjust a value of an input component to produce an output component value that is gamma corrected for the current refresh rate. In one embodiment, the current refresh rate is the reciprocal of the duration of the currently displayed image. The duration of the currently displayed image may be measured as a time between the rising edge of vsync pulses, a time between a particular pixel (e.g. first) being displayed, and the like.

At step 215, the adjusted image comprising adjusted component values is output for display on the screen of the display device. In one embodiment, the display device is a variable refresh rate display.

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

In most variable refresh rate displays, the arrival time of each new frame of image data is unknown, and a heuristic based on past events may be used to estimate the arrival time of the next frame of image data. The estimated arrival time may be utilized to find a number of times the previous frame of image data should be refreshed on the display device in order to ensure that the display device is operating within specifications provided by the display device as to a minimum and maximum refresh frequency of the display device. The estimated arrival time is a next image duration representing the time required to render the next image data (e.g., second image) into a frame buffer and, consequently, the time that the current image data (first image) will be displayed by the display device while waiting for the next image data to be received. Importantly, as previously explained, the frame duration is independent of the image duration. The frame duration corresponds to the frame rate, and the frame rate is defined as the rate at which the display is refreshed with the image data that may, or may not, have changed. The refresh rate is also defined as the rate at which the display is refreshed with the image data that may, or may not, have changed.

In one embodiment, the refresh timeout may be computed based on the estimated next image duration and/or the image duration of one or more previous images. For example, the refresh timeout may be computed so that repeated frames are spaced equidistantly between each new image. In one embodiment, a timing controller in the display device calculates an estimate for the next image duration and/or the refresh timeout. In another embodiment, a scaling unit in the display device calculates an estimate for the next image duration and/or the refresh timeout. In yet another embodiment, a processor external to the display device, such as a GPU, calculates an estimate for the next image duration and/or the refresh timeout.

When the LCD panel gamma varies based on the refresh rate, the refresh rate dependent gamma correction factors are continuously updated based on the frame duration of the currently displayed image. Before the start of each frame, gamma correction factors specific for the current refresh rate may be written into gamma look-up tables. Alternatively, multiple gamma look-up tables may be available that each store gamma correction factors associated with a particular refresh rate.

Figure 3A:
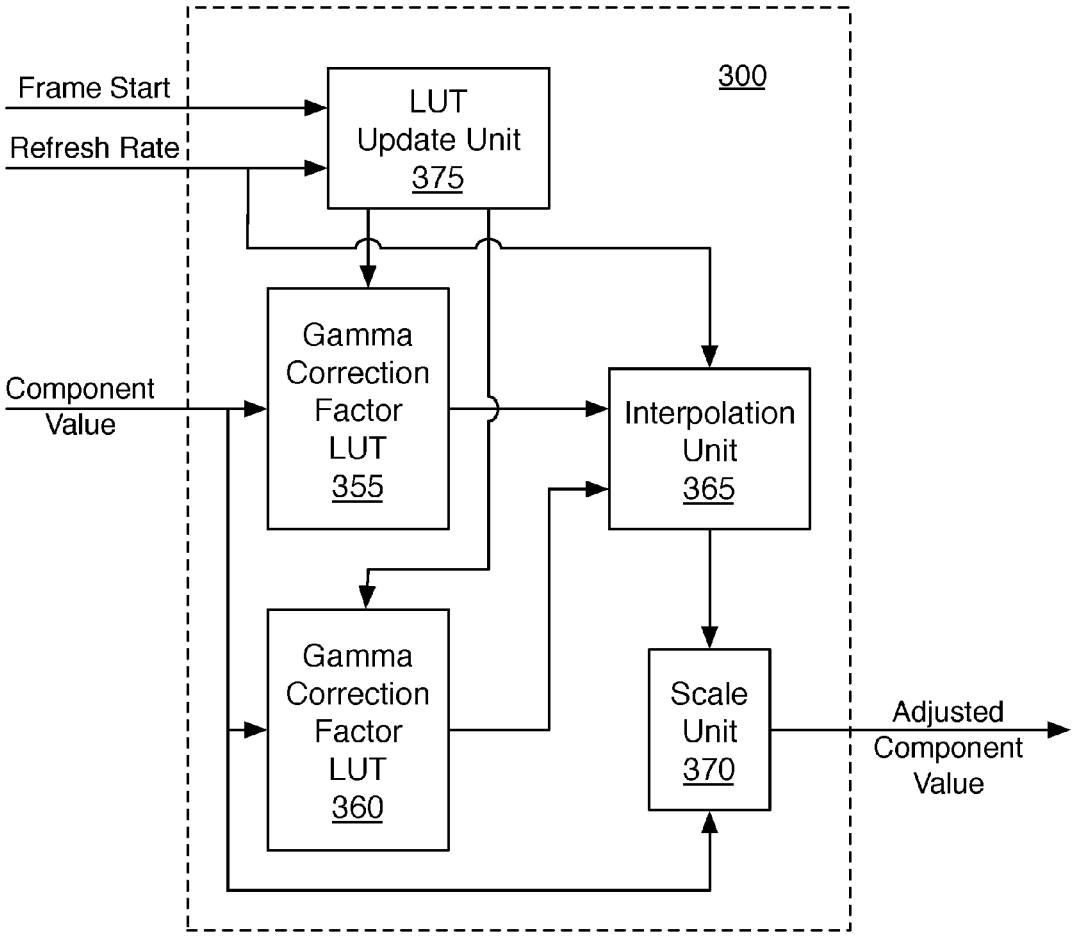
FIG. 3A illustrates a block diagram of a refresh rate dependent gamma correction unit, in accordance with one embodiment.

FIG. 3A illustrates a block diagram of a refresh rate dependent gamma correction unit 300, in accordance with one embodiment. In one embodiment, the refresh rate dependent gamma correction unit 300 is configured to perform gamma correction for one component and multiple refresh rate dependent gamma correction units 300 may be used in parallel to perform gamma correction for more than one component in parallel. The refresh rate dependent gamma correction unit 300 includes a LUT update unit 375, gamma correction factor LUTs 355 and 360, an interpolation unit 365, and a scale unit 370. The refresh rate dependent gamma correction unit 300 receives a component value, a refresh rate, and a frame start signal and computes an adjusted component value that is gamma corrected based on the refresh rate. In one embodiment, the refresh rate is computed based on the frame start signal.

The LUT update unit 375 receives a frame start signal and refresh rate and determines if the refresh rate has changed since the last frame was displayed. If the refresh rate has changed, then the LUT update unit 375 loads gamma correction parameters into the gamma correction factor LUTs 355 and 360 corresponding to the refresh rate. In one embodiment, a first set of gamma correction parameters and a second set of gamma correction factors are written to the gamma correction factor LUTs 355 and 360, respectively. The first and second sets of gamma correction parameters are associated with refresh rates that are closest to a refresh rate for a currently displayed image (e.g., the current refresh rate), where one of the first and second sets of gamma correction parameters is associated with a first refresh rate that is equal to or larger than the refresh rate and the other set of gamma correction parameters is associated with a second refresh rate that is equal to or smaller than the refresh rate. In one embodiment, the LUT update unit 375 computes the refresh rate using the frame start signal.

For each input component value, a gamma correction factor is read from the gamma correction factor LUTs 355 and 360. The interpolation unit 365 interpolates between the gamma correction factors read from the gamma correction factor LUTs 355 and 360 based on a fractional portion of the current refresh rate to produce a refresh rate dependent gamma correction value. The scale unit 370 multiplies the component value by the refresh rate gamma correction value to produce the adjusted component value. In one embodiment, the adjusted component values are stored in the gamma correction factor LUTs 355 and 360 so the interpolation unit 365 computes the adjusted component values and the scale unit 370 is not included in the refresh rate dependent gamma correction unit 350.

In one embodiment, one of the gamma correction factor LUTs 355 and 360 and the interpolation unit 365 are omitted and a single gamma correction factor LUT 355 is used. The single gamma correction factor LUT 355 is written by the LUT update unit 375 with the gamma correction factors associated with the refresh rate that is closest to the current refresh rate. The component value is input to the single gamma correction factor LUT 355 and the gamma correction factor that is read is input to the scale unit 370.

In one embodiment, the refresh rate is provided to a CPU or GPU and the CPU or GPU computes gamma correction factors for the refresh rate when the frame start signal is received and then writes the computed gamma correction factors to the single gamma correction factor LUT 355. In one embodiment, the gamma correction factor LUTs 355 and 360 and the interpolation unit 365 are replaced with circuitry configured to implement mathematical formulas such as Bezier curves or splines to adjust the component value.

Figure 3B:
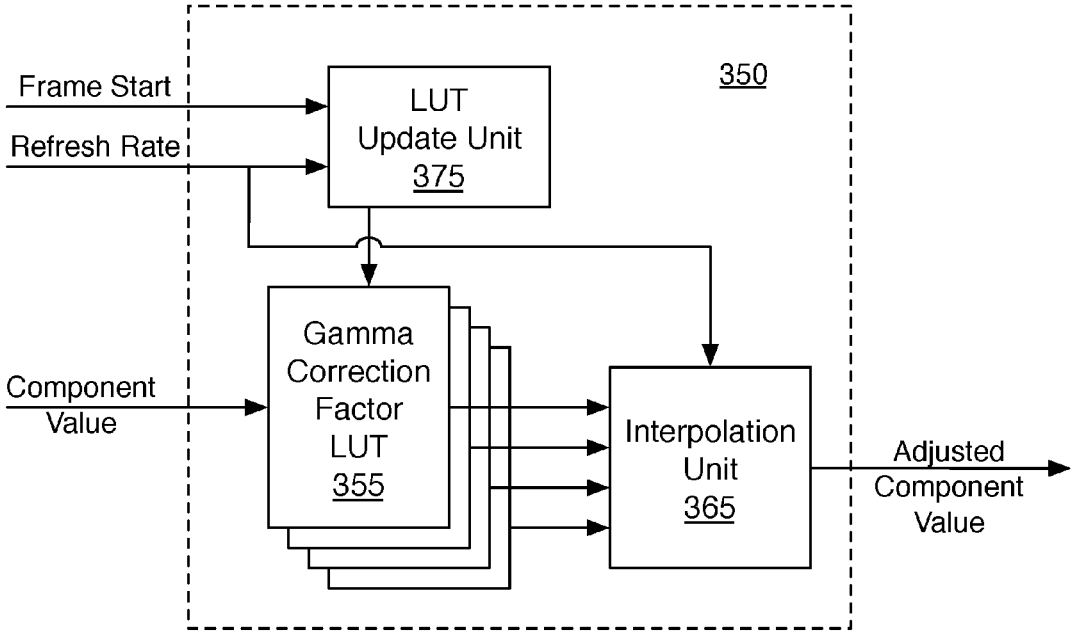
FIG. 3B illustrates a block diagram of another refresh rate dependent gamma correction unit, in accordance with one embodiment.

FIG. 3B illustrates a block diagram of another refresh rate dependent gamma correction unit 350, in accordance with one embodiment. In one embodiment, the refresh rate dependent gamma correction unit 350 is configured to perform gamma correction for one component and multiple refresh rate dependent gamma correction units 350 may be used in parallel to perform gamma correction for more than one component in parallel. The refresh rate dependent gamma correction unit 350 includes a LUT update unit 375, N gamma correction factor LUTs 355, where N>2, and an interpolation unit 365. The refresh rate dependent gamma correction unit 350 receives a component value, a refresh rate, and a frame start signal and computes an adjusted component value that is gamma corrected based on the refresh rate. In one embodiment, the refresh rate is computed based on the frame start signal.

Component values are stored as the gamma correction factors in the N gamma correction factor LUTs 355 so the interpolation unit 365 computes adjusted component values and the scale unit 370 is not included in the refresh rate dependent gamma correction unit 350. Each one or the N gamma correction factor LUTs 355 stores a set of gamma correction factors corresponding to a different refresh rate, where the gamma correction factors are refresh rate dependent component values. The LUT update unit 375 writes the N gamma correction factor LUTs 355 once and selects at least one of the N gamma correction factor LUTs 355 based on the current refresh rate for output to the interpolation unit 365. Refresh rate dependent component values are read from one or two of the gamma correction factor LUTs 355 and the refresh rate dependent component values are interpolated by the interpolation unit 365 to produce the adjusted component value. The interpolation unit 365 interpolates between the refresh rate dependent component values read from the gamma correction factor LUTs 355 based on a fractional portion of the current refresh rate to produce the adjusted component value.

The LUT update unit 375 may be configured to write new values to one or more of the N gamma correction factor LUTs 355. For example, the LUT update unit 375 may write new values to one or more of the N gamma correction factor LUTs 355 when the LCD panel is switched from 200 Hz GSYNC® mode to a 60 Hz fixed refresh rate mode.

In a conventional system, the LCD panel will already have a fixed gamma that is not necessarily the desired one. In such a conventional system, a gamma correction block applies a fixed correction factor so that the combined behavior from the input all the way to the LCD panel output results in the desired gamma corrected color. A significant issue with conventional techniques is that the correction factors stored in the gamma correction block cannot be updated at the start of each incoming frame. Furthermore, conventional gamma correction techniques do not typically interpolate between different gamma correction parameters.

Figure 3C:
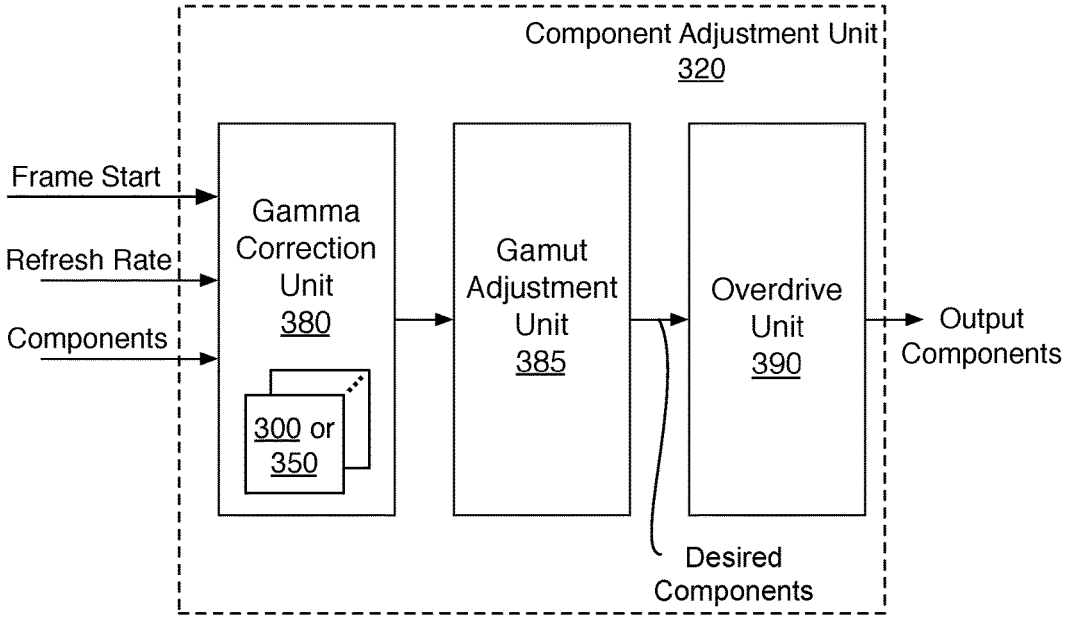
FIG. 3C illustrates a block diagram of a component adjustment unit including the refresh rate dependent gamma correction unit shown in FIG. 3A or 3B, in accordance with one embodiment.
Figure 3D:
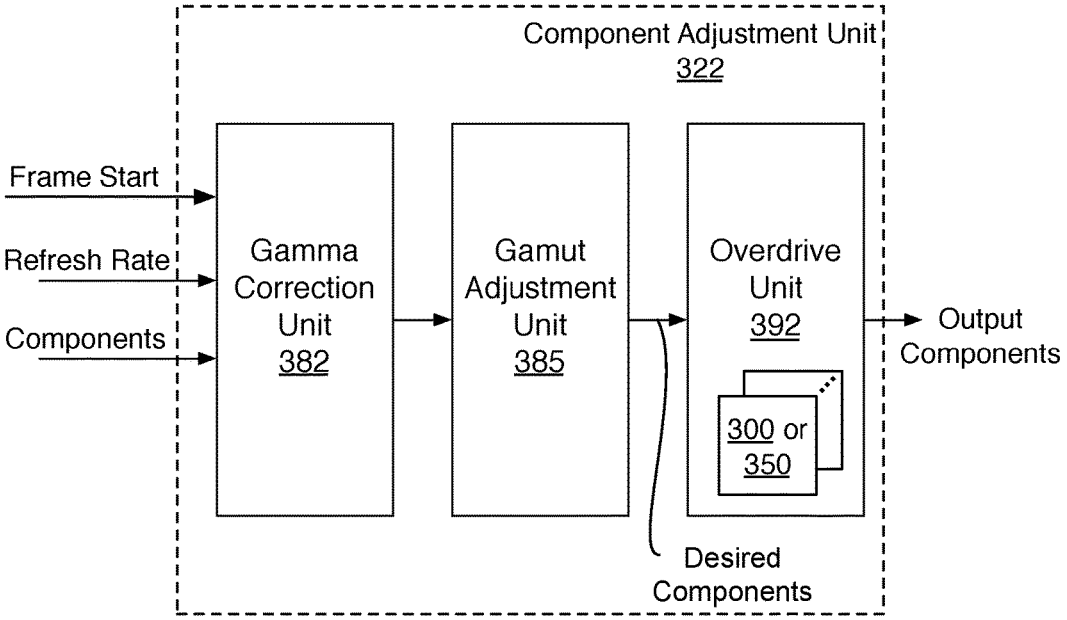
FIG. 3D illustrates a block diagram of another component adjustment unit including the refresh rate dependent gamma correction unit shown in FIG. 3A or 3B, in accordance with one embodiment.

FIG. 3C illustrates a block diagram of a component adjustment unit 320 including the refresh rate dependent gamma correction unit 300 shown in FIG. 3A or the refresh rate dependent gamma correction unit 350 shown in FIG. 3B, in accordance with one embodiment. The component adjustment unit 320 receives the input components, frame start signal, and refresh rate as inputs and generates output components for display. The refresh rate dependent gamma correction may be performed in either a gamma correction unit 380 or, as shown in FIG. 3D, in an overdrive unit 390. Additionally, in one embodiment, the order of processing is modified so that the order of a gamut adjustment unit 385 and the gamma correction unit 380 is reversed and gamut adjustment processing is performed before the refresh rate dependent gamma correction processing. The gamut adjustment unit 385 is configured to adjust component values to be within a predetermined range. The predetermined range may vary for different components and typically is defined by a standard.

In one embodiment, the gamma correction unit 380 includes at least one refresh rate dependent gamma correction unit 300 or 350 to adjust the component values based on the refresh rate. The overdrive unit 390 receives desired components and is configured to calculate the output component value to be driven to the LCD panel for a particular pixel. The desired component values are the values that a person viewing the image should perceive. The value of an output component is based on the corrected component value of the particular pixel for the next frame and the output component value that was driven to the LCD panel for the particular pixel in the current frame. The overdrive unit 390 corrects the desired component values so that the values will be perceived correctly by a viewer.

Conventionally, for a stable image where the next component value and the current component value for a pixel are identical, the operation performed by the overdrive unit 390 is a unity function. In other words, if the next component value for the pixel is x, and the current component value for the pixel was also x, the value of the output component generated by the overdrive unit 390 is also x. A variable refresh rate monitor, such as a G-SYNC® monitor, varies the overdrive strength based on the current refresh rate. This is because at a lower refresh rate, the liquid crystal fluid inside the LCD panel has a longer time to reach the correct position than at a higher refresh rate. Therefore, less overdrive is needed for a lower refresh rate compared with a higher refresh rate.

In one embodiment, the overdrive unit 390 includes one or more overdrive look-up tables, where each look-up table is associated with a different refresh rate. The corrected component value is input to the overdrive look-up table(s) and an overdrive value is read from the look-up table(s). Two overdrive values may be interpolated based on at least a portion of the refresh rate to produce a final overdrive value that is used to adjust the corrected component value. When the overdrive unit 390 includes overdrive look-up table(s) and interpolation circuitry, the refresh rate dependent gamma correction operations may be performed by the overdrive unit 390, as shown in FIG. 3D. However, in some embodiments, even when the image is stable and the component values of a pixel in the next image are unchanged compared with the current image, the operation performed by the overdrive unit 390 produces a new component value that is not identical to the current component value for a pixel.

FIG. 3D illustrates a block diagram of a component adjustment unit 322 including the refresh rate dependent gamma correction unit 300 shown in FIG. 3A or the refresh rate dependent gamma correction unit 350 shown in FIG. 3B, in accordance with one embodiment. The component adjustment unit 322 receives the input components, frame start signal, and refresh rate as inputs and generates output components for display. The refresh rate dependent gamma correction is performed in an overdrive unit 392 instead of in the gamma correction unit 382. The gamma correction unit 382 may be configured to perform conventional gamma correction and the refresh rate dependent gamma correction unit 350 may be configured to perform an additional gamma correction based on the refresh rate. In one embodiment, the refresh rate dependent gamma correction unit(s) 300 or 350 are configured to perform overdrive operations and gamma correction based on the refresh rate. For example, within the refresh rate dependent gamma correction unit(s) 300 or 350, the gamma correction factor LUT 355 may be written by the LUT update unit 375 with gamma correction factors that also perform adjustments for overdrive operations.

FIG. 4A illustrates overdrive component values, configured to perform only overdrive operations, in accordance with one embodiment. The table shown in FIG. 4A may be stored in the overdrive unit 390. Each row corresponds to a different component value in the frame being displayed on the LCD panel (i.e., the output component generated by the overdrive unit 390 for the frame currently displayed). Each column corresponds to a different desired component value to be displayed in the next frame (i.e., the desired component value received by the overdrive unit 390). For each component of each pixel, the new output component value is selected based on the desired component value (e.g., column select) and the current component value (e.g., row select) that was driven to the LCD panel for the pixel in the current frame. The component value stored in the entry at the selected row and column is read from the table and output to the LCD panel for display.

FIG. 4B illustrates overdrive component values, configured to perform overdrive operations and gamma correction based on the refresh rate, in accordance with one embodiment. The component values in the table shown in FIG. 4B are associated with one refresh rate and may be stored as gamma correction factors in the gamma correction factors LUTs 355 and/or 360 within the refresh rate dependent gamma correction units 300 or 350 that are included within the overdrive unit 392. Additional tables with different component values associated with other refresh rates may be stored in other gamma correction factors LUTs 355 and/or 360 within the refresh rate dependent gamma correction units 300 or 350 that are included within the overdrive unit 392. Each row of the table shown in FIG. 4B corresponds to a different component value in the frame being displayed on the LCD panel (i.e., the current component generated by the overdrive unit 392 for the frame currently displayed). Each column corresponds to a different desired component value to be displayed in the next frame (i.e., the desired component value received by the overdrive unit 392). For each component of each pixel, the new output component value is selected based on refresh rate (e.g., table select), the desired component value (e.g., column select), and the current component value (e.g., row select) that was driven to the LCD panel for the pixel in the current frame. Specifically, the component value stored in the entry of the selected gamma correction factors LUTs 355 or 360 at the selected row and column is read from the gamma correction factors LUTs 355 or 360. The interpolation unit 365 may interpolate between the component values read from the gamma correction factor LUTs 355 and 360 based on a fractional portion of the current refresh rate to produce a refresh rate dependent gamma corrected and overdrive adjusted component value for output to the LCD panel for display.

In one embodiment, the overdrive unit 390 or 392 uses the desired component value for the current frame instead of the current component value (i.e., output of the overdrive unit 390 or 392 for the current frame). In such an embodiment, the desired component value for the current frame is used as the row select to read a component value from the selected gamma correction factors LUTs 355 or 360 and, for each component of each pixel, the new output component value is selected based on refresh rate (e.g., table select), the desired component value (e.g., column select), and the desired component value (e.g., row select) that was input to the overdrive unit 390 or 392 for the pixel in the current frame.

Additionally, in one embodiment, the order of processing is modified so that the order of a gamut adjustment unit 385 and the gamma correction unit 382 is reversed and gamut adjustment processing is performed before conventional gamma correction processing. In one embodiment, the gamma correction unit 382 is omitted.

Figure 4C:
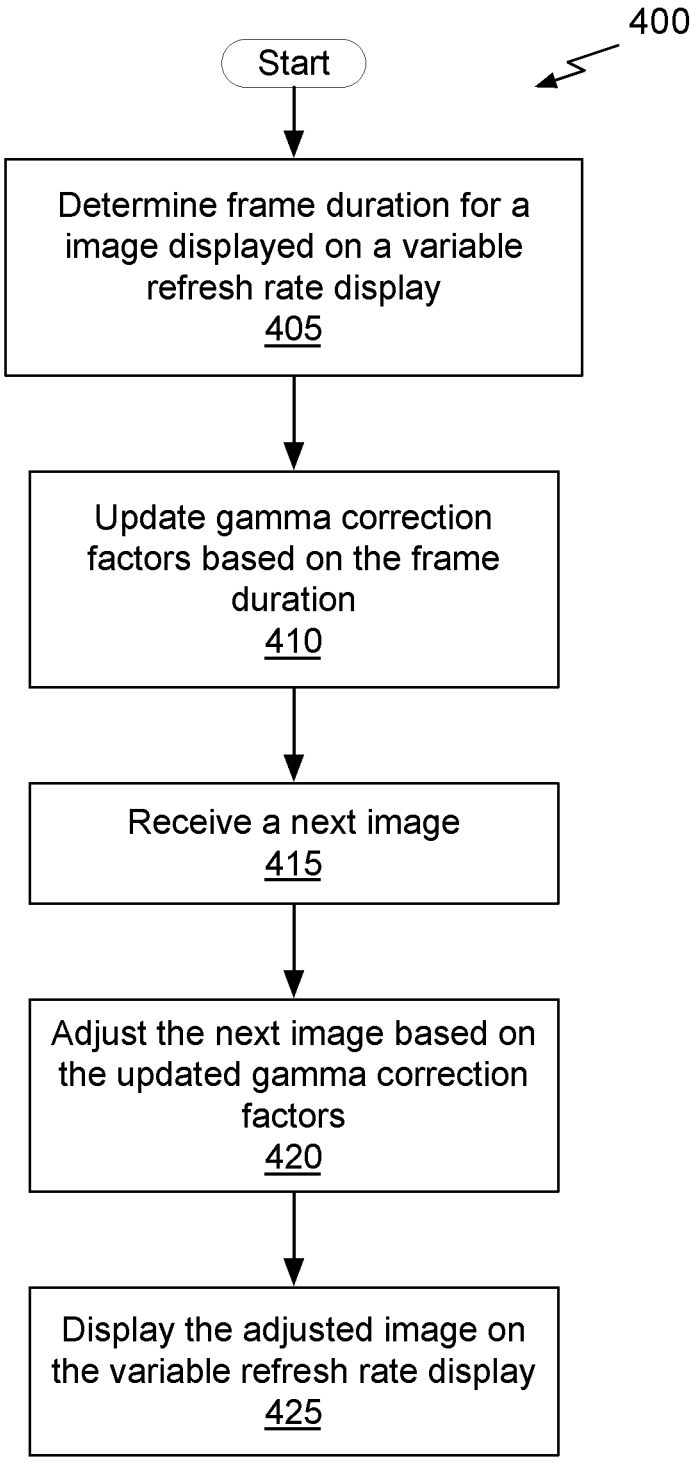
FIG. 4C illustrates a flowchart of a method for determining gamma correction factors for a dynamic refresh frequency capable display device, in accordance with one embodiment.

FIG. 4C illustrates a flowchart of a method 400 for determining gamma correction factors for a dynamic refresh rate capable display device, in accordance with one embodiment. Although method 200 is described in the context of the component adjustment unit 320 or 322, the method 400 may also be performed by a program, custom circuitry, or by a combination of custom circuitry and a program. Furthermore, persons of ordinary skill in the art will understand that any system that performs method 400 is within the scope and spirit of embodiments of the present invention.

At step 405, a frame duration for an image displayed on a variable refresh rate display is determined. At step 410, gamma correction factors are updated by the LUT update unit 375 based on the frame duration. In one embodiment, the frame duration is used to compute a refresh rate and the refresh rate is used to update the gamma correction factors. When the refresh rate dependent gamma correction unit 300 or 350 is included within the overdrive unit 392, the gamma correction factors may also be configured to perform both overdrive operations and gamma correction based on the refresh rate. In one embodiment, when the frame duration is unchanged, the LUT update unit 375 does not update the gamma correction factors.

At step 415, a next image is received. Note, that the next image may be identical to the current image. At step 420, the next image is adjusted by the refresh rate dependent gamma correction unit(s) 300 or 350 based on the updated gamma correction factors. At step 425, the adjusted image is displayed on the variable refresh rate display.

Figure 5A:
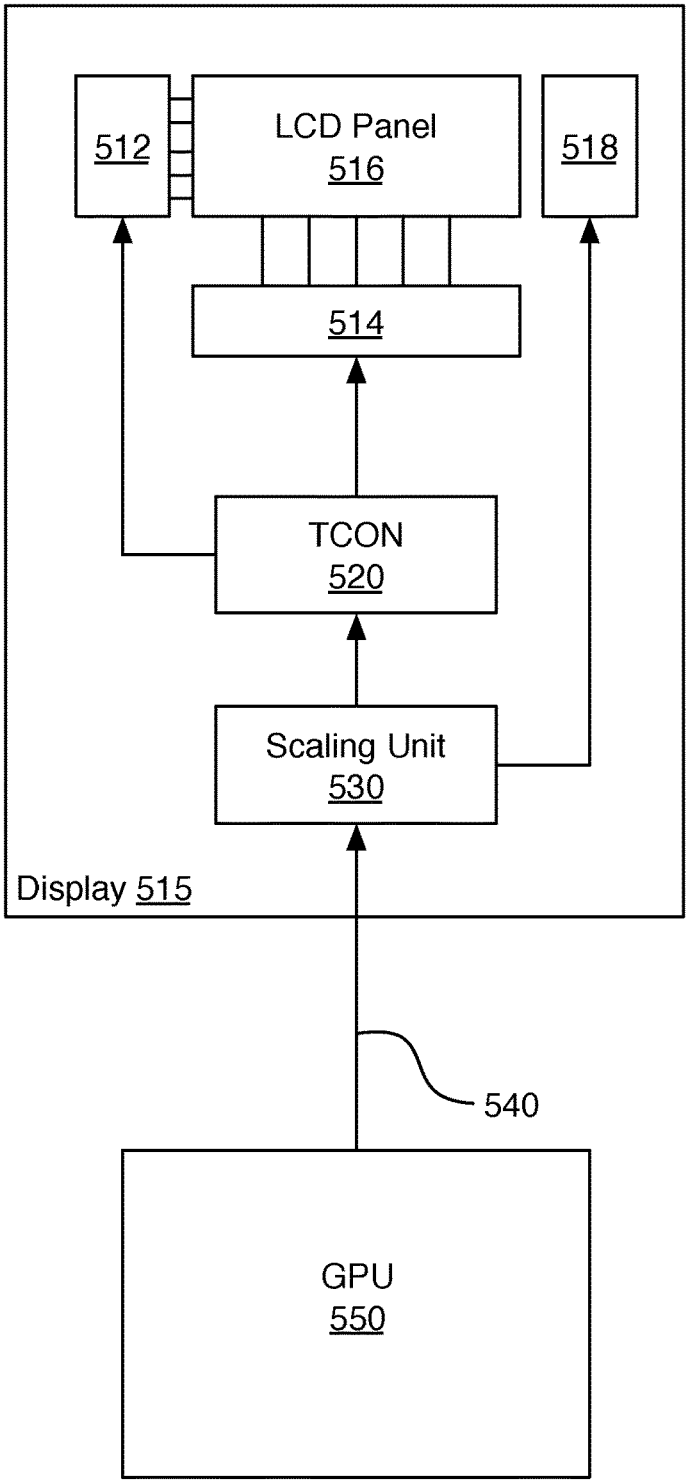
FIG. 5A illustrates a system that includes a dynamic refresh frequency capable display, in accordance with one embodiment.

FIG. 5A illustrates a system that includes a dynamic refresh frequency capable display 515, in accordance with one embodiment. A GPU 550 may render frames of image data based on 3D primitives defined by an application executing on a CPU (not explicitly shown). The frames of image data may include pixel data stored in a frame buffer, which is a portion of memory allocated to store pixel data that is utilized to generate a video signal transmitted over a video interface 540. In one embodiment, the GPU 550 may be associated with a dual frame buffer (or ping-pong buffer) that includes a first portion of the frame buffer that stores pixel data for a previously rendered frame that is read out of memory and encoded within the video signal transmitted via the video interface 540 and a second portion of the frame buffer that stores pixel data for the current frame being rendered by the GPU 550. Once the GPU 550 has completed rendering of the current frame, the roles of the first portion of the frame buffer and the second portion of the frame buffer may be switched such that the second portion of the frame buffer stores pixel data for the recently rendered frame that is read out of memory and encoded within the video signal transmitted via the video interface 540 and the first portion of the frame buffer stores pixel data for the next frame being rendered by the GPU 550. The roles of the first and second portion of the frame buffer may alternate after each frame is rendered.

In one embodiment, the display 515 includes an LCD panel 516 that includes a plurality of pixel elements, each pixel element comprising a plurality of liquid crystal elements corresponding to a plurality of color components (e.g., a red component, a green component, and a blue component). The display 515 may also include row drivers 512 and column drivers 514 for controlling each of the pixel elements in the LCD panel 516. The row drivers 512 and column drivers 514 enable each individual pixel element in the LCD panel 516 to be addressed and each liquid crystal element of the pixel element to have a voltage applied thereto in order to vary a level of the corresponding color component displayed by the pixel element.

The display 515 also includes a backlight 518, which may comprise one or more compact fluorescent lights (CFLs) arranged around an edge or edges of the LCD panel 516, one or more LEDs arranged around the edge or edges of the LCD panel 516, or an array of LEDs arranged behind the pixel elements of the LCD panel 516. It will be appreciated that, in some embodiments, the display 515 may be an OLED panel or AMOLED panel that does not include the backlight 518.

The display 515 may also include a timing controller (TCON) 520 and a scaling unit 530. The TCON 520 controls the row drivers 512 and the column drivers 514 in order to display the frames of image data on the LCD panel 516. The scaling unit 530 receives the video signal from a GPU 550 via the video interface 540. The video signal may correspond to a particular video signal format, such as a digital video signal format or an analog video signal format. Exemplary digital video signal formats include DVI (Digital Visual Interface), HDMI (High-Definition Multimedia Interface), and the like. Exemplary analog video signal formats include NTSC (National Television System Committee), PAL (Phase Alternating Line), VGA (Video Graphics Array), and the like.

The particular image data received via the video interface 540 may have a resolution that does not match a native resolution of the LCD panel 516. Thus, the scaling unit 530 is configured to scale the image frames encoded within the video signal to match the native resolution of the LCD panel 516. The scaling unit 530 may be configured to scale the images in the horizontal direction and/or the vertical direction. In one embodiment, the scaling unit 530 may filter the images. The scaling unit 530 may include the component adjustment unit 320 or 322 to perform refresh rate dependent gamma correction and/or overdrive operations. In yet another embodiment, where display 515 comprises a direct drive monitor or an LCD panel 516 included in a laptop computer, display 515 may not include a scaling unit 530.

The scaling unit 530 may also control the backlight 518. For example, the scaling unit 530 may determine a particular level of illumination the backlight 518 should provide for a given frame of image data and control the backlight 518 to provide the particular level of illumination. In an alternate embodiment, the display 515 may include a separate circuit that controls the backlight 518 such that the scaling unit 530 does not control the backlight 518.

Figure 5B:
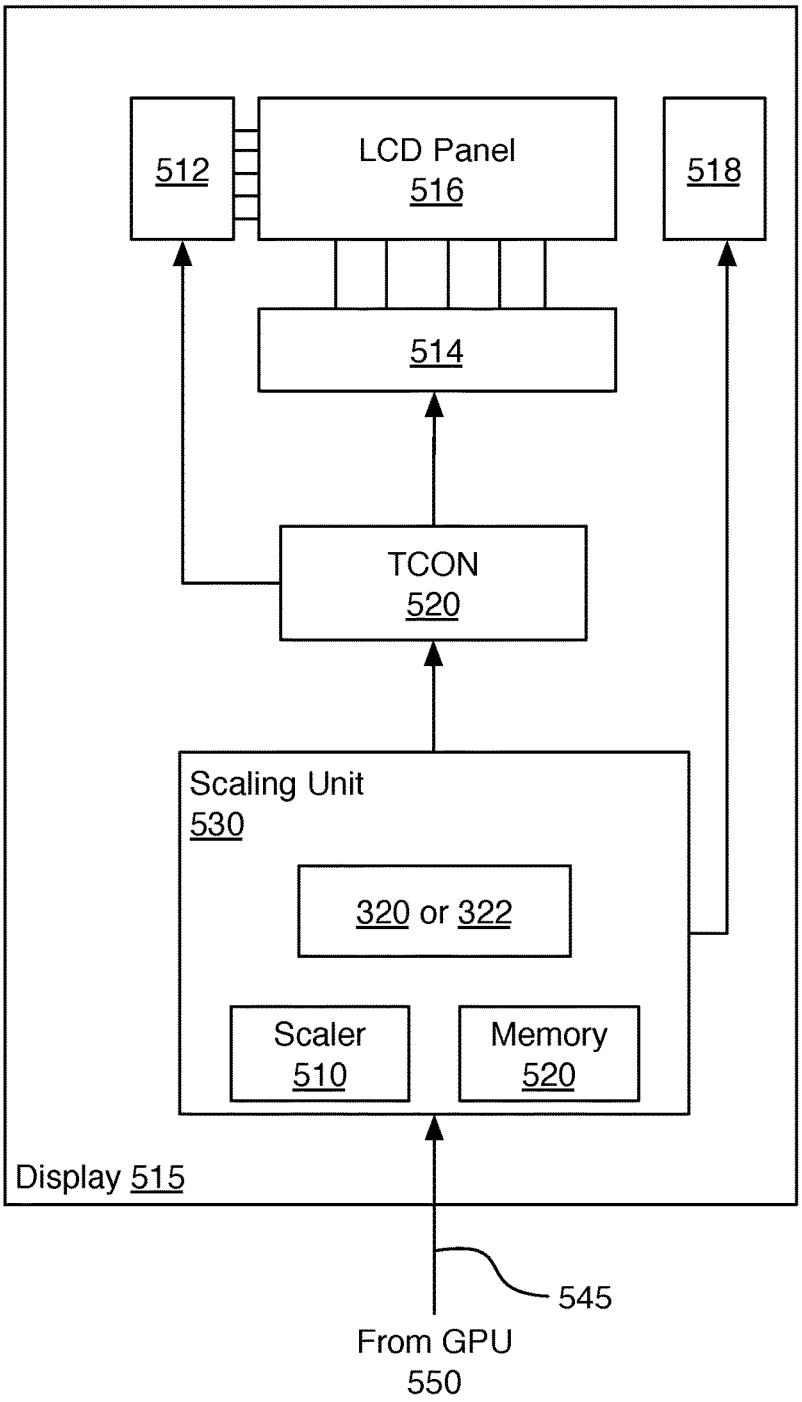
FIG. 5B illustrates the operation of the scaling unit of FIG. 5A, in accordance with another embodiment.

FIG. 5B illustrates the operation of the scaling unit 530 of FIG. 5A, in accordance with another embodiment. In another embodiment, the logic for ensuring that the display device refreshes the LCD panel 516 within the lower and upper bounds for the refresh frequency of the display device is implemented within the display device. For example, the display 515 may be configured to adjust the dynamic refresh frequency of the display 515 by repeatedly causing the LCD panel 516 to be refreshed by redisplaying the previous image in order to keep the dynamic refresh frequency within the lower and upper bounds for the refresh frequency of the display 515. In such an embodiment, the GPU 550 may simply transmit each image to the display 515 one time over the interface 545 and then the display 515 handles the logic for repeatedly displaying the image.

Again, the scaling unit 530 is configured to scale the images encoded in the video signals received via the interface 545 to match a native resolution of the display 515. As shown in FIG. 5B, the scaling unit 530 may include a scaler 510, and a local memory 520. The scaling unit 530 may also include the component adjustment unit 320 or 322 to perform refresh rate dependent gamma correction and/or overdrive operations. The scaling unit 530 may be a fixed function hardware unit embodied on an ASIC (application specific integrated circuit) included in the display 515. In another embodiment, the scaling unit 530 may be included on a larger ASIC that includes the TCON 520. In one embodiment, the local memory 520 includes on-chip DRAM used to store image data. In another embodiment, the local memory 520 includes a cache associated with off-chip DRAM accessible by the scaling unit 530 via an interface. Image data and/or refresh rate dependent gamma correction parameters may be stored in the off-chip DRAM and fetched into the cache as needed.

The scaler 510 may receive each image at a resolution generated by the GPU 550. The scaler 510 may determine the resolution of the images by analyzing the video signal (i.e., counting the number of pixels between horizontal synchronization signals and/or vertical synchronization signals), or the scaler 510 may receive a configuration signal from the GPU 550 over the interface 545 that specifies a resolution of the images transmitted over the interface 545. The scaler 510 may then scale the images from the original resolution provided by the GPU 550 to the native resolution of the display 515. When the original resolution matches the native resolution, then no scaling of the images may be required. The scaled image data may be generated via, e.g., interpolating one or more values in the original image data to generate values for each pixel location in the scaled image data at the native resolution. The image data may be stored in the local memory 520 and filtered (e.g., interpolated, etc.) to generate scaled image data. The component adjustment unit 320 or 322 performs refresh rate dependent gamma correction and/or overdrive operations on the scaled image data to produce output components. In one embodiment, the scaled image data is output to the TCON 520 to be displayed on the LCD panel 516 using polarity specified by the polarity control signals.

In one embodiment, the scaling unit 530 is also configured to manage dynamic frame repetition based on the minimum and maximum allowed frame durations of the display 515. The display 515 may be configured to ensure that the LCD panel 516 is refreshed at a rate that falls between the lower and upper bounds for the refresh frequency of the display, even though the incoming video signal may not adhere to these requirements. In such an embodiment, the GPU 550 may be configured to simply transmit the image data to the display 515 when the image data have been fully rendered into the frame buffer. Image data for each image may only be transmitted to the display 515 one time. Once the scaling unit 530 has caused a previous image to be presented on the LCD panel 516, the scaling unit 530 may calculate an estimate for the current image duration.

In one embodiment, the scaling unit 530 determines the image durations associated with each image included in the video signal by calculating a delay between the start of each image received by the scaling unit 530 via the interface 545, utilizing, e.g., a system clock included in the display 515 and timestamps associated with the images stored in the memory 520. The start of each image may be characterized by a vertical synchronization signal included in the video signal that cause the display 515 to store a timestamp in the memory 520 that indicates a time associated with the start of that image.

In another embodiment, the GPU 550 transmits metadata associated with each image that includes the image duration for the previous image in the video signal transmitted via the interface 545. The scaling unit 530 reads the image durations from the video signal and determines an estimate for the current image duration based on one or more image durations received in the video signal. Once the scaling unit 530 has determined an estimate for the current image duration, a refresh timeout may be calculated. The refresh timeout will control the number of times that the previous frame of image data is repeated. Then the scaling unit 530 may cause the scaled image data for the previous image to be repeatedly displayed depending on the refresh timeout value.

Figure 6:
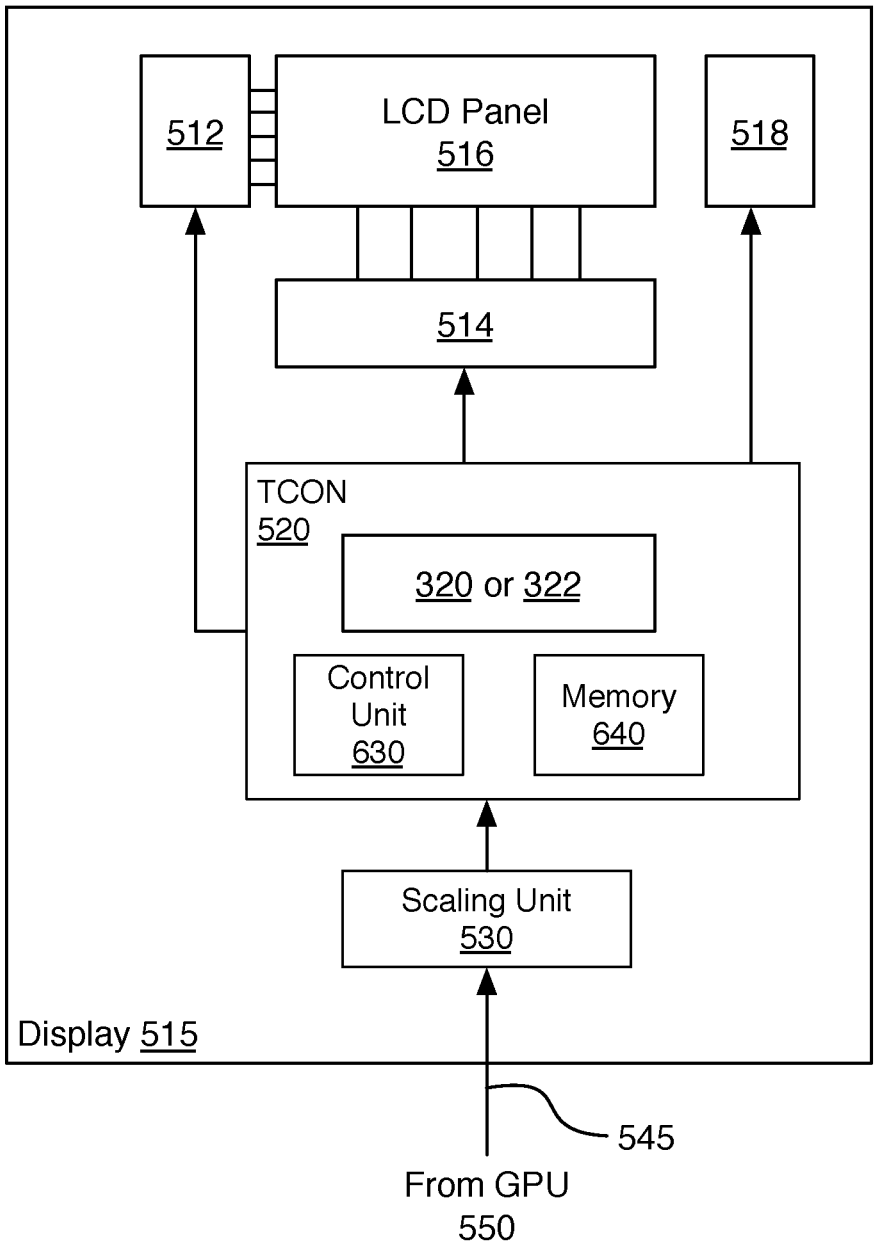
FIG. 6 illustrates the operation of the timing controller (TCON) of FIG. 5A, in accordance with another embodiment.

FIG. 6 illustrates the operation of the TCON 520 of FIG. 5A, in accordance with another embodiment. In yet another embodiment, the logic for ensuring that the display device refreshes the LCD panel 516 within the lower and upper bounds for the refresh frequency of the display device is implemented within the TCON 520 instead of the scaling unit 530.

The TCON 520 includes a control unit 630 and memory 640. The memory 640 may include DRAM and/or registers. The TCON 520 may also include the component adjustment unit 320 or 322 to perform refresh rate dependent gamma correction and/or overdrive operations. The TCON 520 may be a fixed function hardware unit embodied on an ASIC (application specific integrated circuit) included in the display 515. In another embodiment, the TCON 520 may be included on a larger ASIC that includes the scaling unit 530. The control unit 630 is configured to transmit signals to the row drivers 512 and column drivers 514 based on the scaled image data received from the scaling unit 530. The TCON 520 receives scaled image data from the scaling unit 530, where the scaled image data is received in, e.g., row major order one component value at a time. The component adjustment unit 320 or 322 performs refresh rate dependent gamma correction and/or overdrive operations on the scaled image data to produce output components. The control unit 630 then addresses specific pixels utilizing the row drivers 512 and column drivers 514 to change the value of each pixel in the LCD panel 516 based on the output components. In one embodiment, the TCON 520 controls the polarity used for displaying the output components by the LCD panel 516.

Once the TCON 520 has caused the output components for the previous image to be presented on the LCD panel 516, the TCON 520 may calculate an estimate for the current image duration in a similar fashion to the manner implemented by the scaling unit 530, described above. In other words, the TCON 520 may calculate delay times between receiving each scaled image data from the scaling unit 530 and then estimate the current image duration based on the delay times associated with one or more previous scaled images. The scaling unit 530 may then use this estimate of the current image duration to calculate the refresh timeout. Finally, the refresh timeout may cause the previous scaled image to be repeatedly presented on the LCD panel 516.

In one embodiment, the TCON 520 may be associated with a refresh buffer that stores the scaled image data for the previous image as the scaled image data is received from the scaling unit 530. The refresh buffer may be implemented on the ASIC in memory 640. The refresh rate dependent gamma correction factors may also be stored in the memory 640. In another embodiment, the refresh buffer may be implemented in off-chip memory accessible by the TCON 520 via a cache in memory 640 and a memory interface. For example, the refresh buffer may be implemented within an external DRAM and portions of the refresh buffer may be fetched into a cache in memory 640 as needed. The stored scaled image data may then be read by the TCON 520 in order to present the scaled image(s) on the LCD panel 516.

Alternatively, the refresh buffer may be managed by the scaling unit 530. Instead of reading the scaled image data from a memory accessible by the TCON 520, the TCON 520 may be configured to transmit a signal to the scaling unit 530 that causes the scaling unit 530 to retransmit the scaled image data for the previous image to the TCON 520. In other words, the memory 640 associated with the scaling unit 530 may be utilized to implement the refresh buffer instead of storing the scaled image data redundantly.

It will be appreciated that, as described above, adjusting the dynamic refresh frequency of the display device based on the refresh timeout may be implemented by any one of the GPU 550, the scaling unit 530 of the display 515, or the TCON 520 of the display 515. Similarly, the component adjustment unit 320 or 322 may be implemented within the scaling unit 530 of the display 515 or the TCON 520 of the display 515 to perform refresh rate dependent gamma correction and/or overdrive operations. Furthermore, the various embodiments described above may be implemented in the graphics processor 706 and display 708 of system 700, described below.

Figure 7:
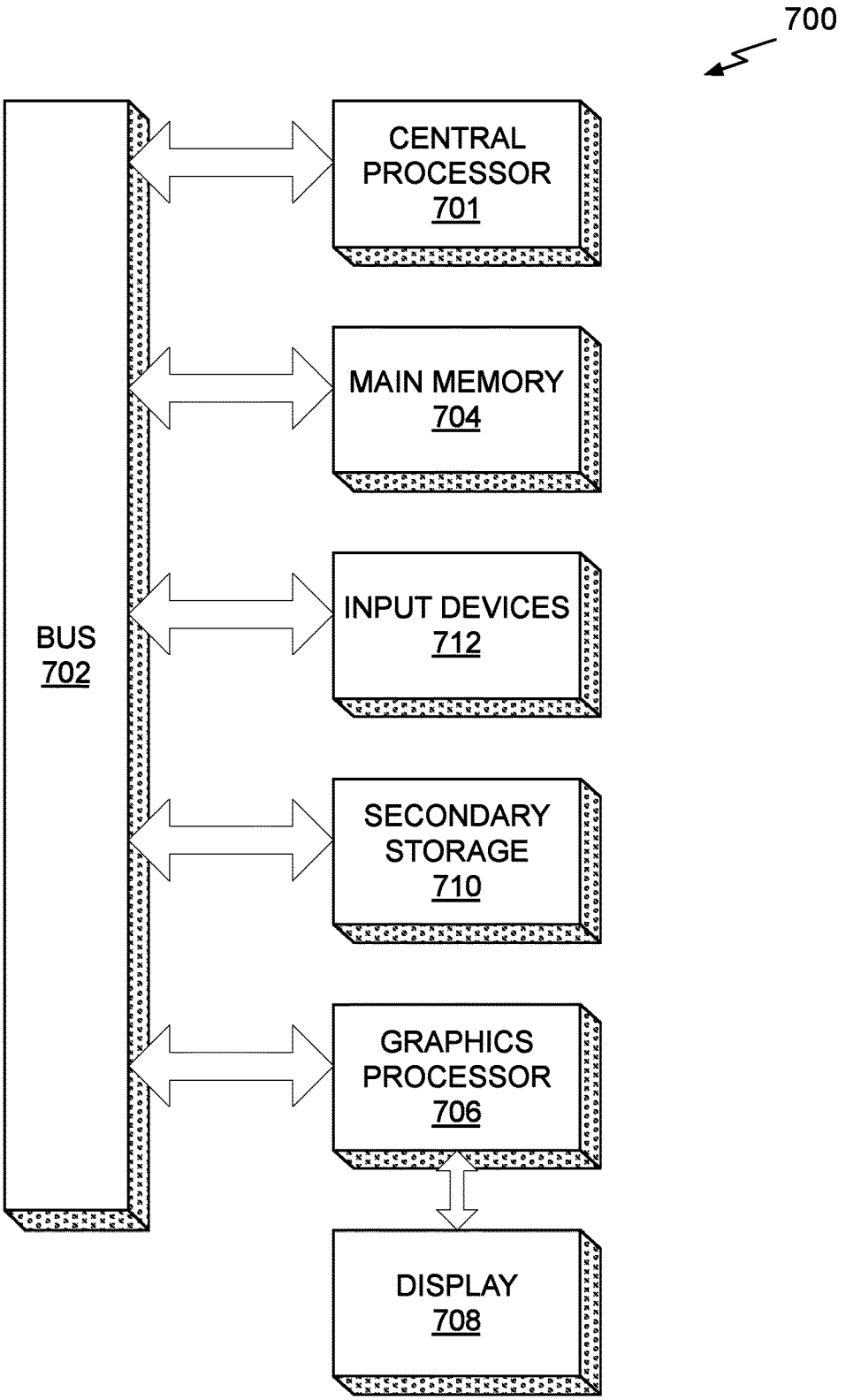
FIG. 7 illustrates an exemplary system in which the various architecture and/or functionality of the various previous embodiments may be implemented.

FIG. 7 illustrates an exemplary system 700 in which the various architecture and/or functionality of the various previous embodiments may be implemented. As shown, a system 700 is provided including at least one central processor 701 that is connected to a communication bus 702. The communication bus 702 may be implemented using any suitable protocol, such as PCI (Peripheral Component Interconnect), PCI-Express, AGP (Accelerated Graphics Port), HyperTransport, or any other bus or point-to-point communication protocol(s). The system 700 also includes a main memory 704. Control logic (software) and data are stored in the main memory 704 which may take the form of random access memory (RAM).

The system 700 also includes input devices 712, a graphics processor 706, and a display 708, i.e. a conventional CRT (cathode ray tube), LCD (liquid crystal display), LED (light emitting diode), plasma display or the like. User input may be received from the input devices 712, e.g., keyboard, mouse, touchpad, microphone, and the like. In one embodiment, the graphics processor 706 may include a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

The system 700 may also include a secondary storage 710. The secondary storage 710 includes, for example, a hard disk drive and/or a removable storage drive, representing a floppy disk drive, a magnetic tape drive, a compact disk drive, digital versatile disk (DVD) drive, recording device, universal serial bus (USB) flash memory. The removable storage drive reads from and/or writes to a removable storage unit in a well-known manner.

Computer programs, or computer control logic algorithms, may be stored in the main memory 704 and/or the secondary storage 710. Such computer programs, when executed, enable the system 700 to perform various functions. The memory 704, the storage 710, and/or any other storage are possible examples of computer-readable media.

In one embodiment, the architecture and/or functionality of the various previous figures may be implemented in the context of the central processor 701, the graphics processor 706, an integrated circuit (not shown) that is capable of at least a portion of the capabilities of both the central processor 701 and the graphics processor 706, a chipset (i.e., a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 700 may take the form of a desktop computer, laptop computer, server, workstation, game consoles, embedded system, and/or any other type of logic. Still yet, the system 700 may take the form of various other devices including, but not limited to a personal digital assistant (PDA) device, a mobile phone device, a television, etc.

Further, while not shown, the system 700 may be coupled to a network (e.g., a telecommunications network, local area network (LAN), wireless network, wide area network (WAN) such as the Internet, peer-to-peer network, cable network, or the like) for communication purposes.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

receiving an image for display on a screen of a display device;

obtaining a first gamma correction factor and a second gamma correction factor, wherein the first and second gamma correction factors depend on a variable refresh rate and the variable refresh rate is based on a refresh frequency specified for the display device and a varying image rendering time;

interpolating between the first gamma correction factor and the second gamma correction factor based on a refresh rate for a currently displayed image to produce a third gamma correction factor corresponding to the refresh rate;

scaling at least one pixel component of the image by the third gamma correction factor; and outputting the adjusted image for display on the screen of the display device.

2. The method of claim 1, further comprising, prior to adjusting the image, writing the first and second gamma correction factors associated with a first refresh rate to a first lookup table.

3. The method of claim 1, further comprising, prior to adjusting the image, determining the refresh rate for the currently displayed image.

4. The method of claim 3, wherein determining the refresh rate comprises measuring a frame duration time for the currently displayed image.

5. The method of claim 1, wherein the first gamma correction factor and the second gamma correction factor are obtained from a look-up-table.

6. The method of claim 1, wherein the first and second gamma correction factors are also configured to perform overdrive operations.

7. The method of claim 1, wherein sets of gamma correction factors are stored in look-up tables, each set of gamma correction factors corresponding to a different refresh rate, and the first and second gamma correction factors are read from a first look-up table of the look-up tables corresponding to the refresh rate for the currently displayed image.

8. The method of claim 1, wherein adjusting the image is performed by circuitry configured to implement a mathematical formula defining a curve to produce the adjusted image based on the refresh rate for the currently displayed image.

9. A system, comprising:

a memory storing an image; and a processor configured to:

receive the image for display on a screen of a display device;

obtain a first gamma correction factor and a second gamma correction factor, wherein the first and second gamma correction factors depend on a variable refresh rate and the variable refresh rate is based on a refresh frequency specified for the display device and a varying image rendering time;

interpolate between the first gamma correction factor and the second gamma correction factor based on a refresh rate for a currently displayed image to produce a third gamma correction factor corresponding to the refresh rate;

scale at least one pixel component of the image by the third gamma correction factor; and output the adjusted image for display on the screen of the display device.

10. The system of claim 9, wherein the processor is further configured to write the first and second gamma correction factors associated with a first refresh rate to a first lookup table.

11. The system of claim 9, wherein the processor is further configured to determine the refresh rate for the currently displayed image prior to adjusting the image.

12. The system of claim 11, wherein the refresh rate is determined by measuring a frame duration time for the currently displayed image.

13. The system of claim 9, wherein the first and second gamma correction factors are also configured to perform overdrive operations.

14. The system of claim 9, wherein the processor comprises circuitry configured to implement a mathematical formula defining a curve to produce the adjusted image based on the refresh rate for the currently displayed image.

15. A non-transitory, computer-readable storage medium storing instructions that, when executed by a processor, cause the processor to perform steps comprising:

receiving an image for display on a screen of a display device;

obtaining a first gamma correction factor and a second gamma correction factor, wherein the first and second gamma correction factors depend on a variable refresh rate and the variable refresh rate is based on a refresh frequency specified for the display device and a varying image rendering time;

interpolating between the first gamma correction factor and the second gamma correction factor based on a refresh rate for a currently displayed image to produce a third gamma correction factor corresponding to the refresh rate;

scaling at least one pixel component of the image by the third gamma correction factor; and outputting the adjusted image for display on the screen of the display device.

16. The non-transitory, computer-readable storage medium of claim 15, further comprising instructions that cause the processor to write the first and second gamma correction factors associated with a first refresh rate to a first lookup table.

17. The non-transitory, computer-readable storage medium of claim 15, further comprising instructions that cause the processor to determine the refresh rate for the currently displayed image prior to adjusting the image.

18. The non-transitory, computer-readable storage medium of claim 17, wherein the refresh rate is determined by measuring a frame duration time for the currently displayed image.

19. The non-transitory, computer-readable storage medium of claim 15, wherein the first and second gamma correction factors are also configured to perform overdrive operations.

20. The non-transitory, computer-readable storage medium of claim 15, wherein sets of gamma correction factors are stored in look-up tables, each set of gamma correction factors corresponding to a different refresh rate, and the first and second gamma correction factors are read from a first look-up table of the look-up tables corresponding to the refresh rate for the currently displayed image.

* * * * *